US005513904A

United States Patent [19]

Vartanian

[11] Patent Number: 5,513,904

[45] Date of Patent: May 7, 1996

[54] MOP HEAD AND METHOD OF MAKING

[75] Inventor: Haig Vartanian, Cheltenham, Pa.

[73] Assignee: Quickie Manufacturing Corporation, Cinnaminson, N.J.

[21] Appl. No.: 408,067

[22] Filed: Mar. 21, 1995

Related U.S. Application Data

[62] Division of Ser. No. 249,441, May 26, 1994, Pat. No. 5,428,858.

[51] Int. Cl.[6] ..... A46D 3/00

[52] U.S. Cl. ..... 300/21

[58] Field of Search ..... 300/21; 15/119.1, 15/119.2, 244.1

[56] References Cited

U.S. PATENT DOCUMENTS

| | | | |
|---|---|---|---|
| 2,221,557 | 11/1940 | Rogers | 15/119.2 X |
| 2,224,462 | 12/1940 | Williams | 15/119.2 X |
| 2,249,912 | 7/1941 | Oxley | 15/244.1 X |
| 2,313,787 | 3/1943 | Vaughn | 15/244.1 |
| 4,077,672 | 3/1978 | Clark, Jr. | 300/21 |
| 4,356,586 | 11/1982 | Klotz | 15/119.2 |
| 4,438,540 | 3/1984 | Senour | 15/119.2 |
| 4,908,901 | 3/1990 | Torres | 15/119.1 |
| 5,035,468 | 7/1991 | Brown et al. | 300/21 |
| 5,428,858 | 7/1995 | Vartanian | 15/244.1 |

*Primary Examiner*—John Husar
*Attorney, Agent, or Firm*—Stuart M. Goldstein

[57] ABSTRACT

The method of assembly of a mop head which includes a polymer carrier in the form of a channel with in-turned lips or barbs on opposed flanges that retain compressed mop material without the need for glue or the like. The method includes compressing a block of mop material between two surfaces to reduce its thickness and to stiffen it, and then driving the compressed mop material into the channel, whereupon expansion of the mop material engages the lips or barbs. The molded polymer carrier channel is relatively rigid and can have reinforcements to resist resilient opening of the channel. The extent of compression of the mop material is substantial, for example, by a factor of four or five during compression, and another factor of two when passing through the nip between the lips.

8 Claims, 5 Drawing Sheets

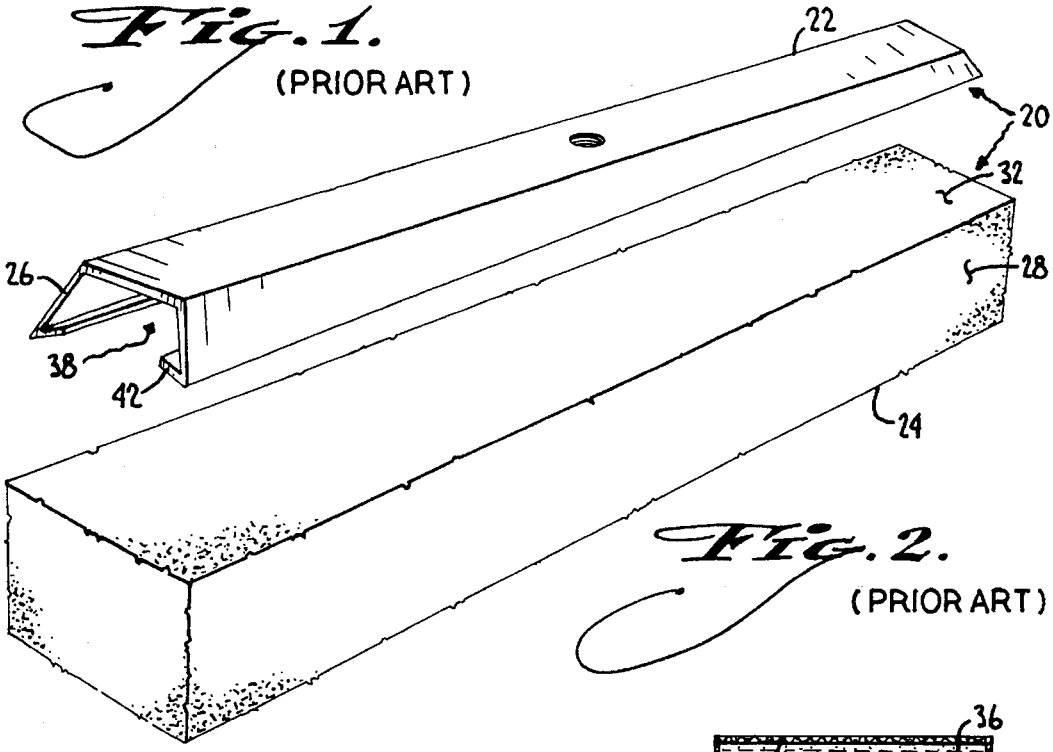
FIG. 1.
(PRIOR ART)
FIG. 2.
(PRIOR ART)
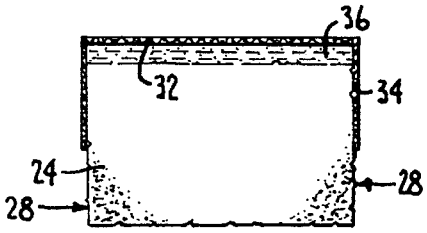
FIG. 3.
(PRIOR ART)
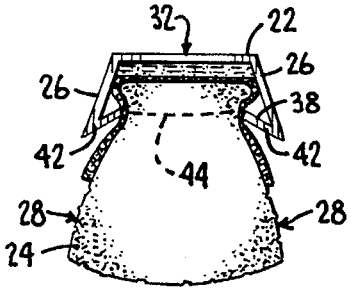
FIG. 4.
(PRIOR ART)
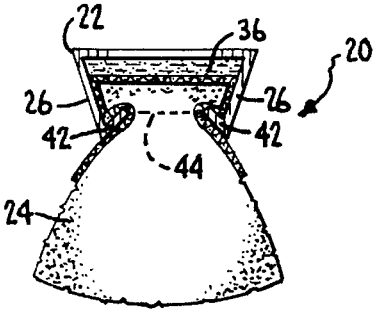
FIG. 5.
(PRIOR ART)

MOP HEAD AND METHOD OF MAKING

This is a division of application Ser. No. 08/249,441, filed May 26, 1994, now U.S. Pat. No. 5,428,858.

BACKGROUND OF THE INVENTION

1. Field of the Invention

The invention relates to the field of mops and the like, having a mop head including a compressible mass or block of material engaged in a channel-shaped carrier by which the mop head is mounted on an elongated handle to form a mop, especially a sponge mop. The invention concerns the particular structure and method steps by which the mop head, and the operative absorbent mop material attached to or integral with the compressible mass, are attached to a carrier channel, and in turn to the handle.

The carrier channel of the invention preferably comprises an integral piece of molded polymer, elongated to correspond substantially to a length of the compressible mass. The carrier defines an open channel between lateral sides that are inclined inwardly and engage the compressible mass at a nip, preferably formed between opposed turned-in lips that can taper to a point. Portions of the compressible mass on either side of the nip (either enclosed in the open channel, or outside the channel and exposed for mopping action) are expanded to a width greater than that of the nip, which locks the compressible mass in the channel. At the nip the mass is substantially compressed. Preferably, portions of the mass inside the channel remain somewhat compressed relative to a rest-state of the mass, while portions outside the channel and remote from the nip fan out to nearly the rest-state of the mass.

The invention also concerns a method of making a mop head from a compressible mass of mop material and a polymer channel as described. The polymer channel is formed to substantially rigid shape prior to its engagement on the mass. Unlike metal channels used for known sponge mops, the polymer channel of the invention is preformed, not ductile, and only minimally deformable if at all. The polymer channel of the invention is not shaped after the sponge or other compressible mass is inserted, as in the prior art, wherein side flanges of ductile metal channels are bent inwardly to squeeze the compressible mass to form the nip. According to the invention, the mop head is assembled by first applying a substantial compressive force against the sides of the mass of mop material, and then applying a driving force between the compressed mop material and the channel, to force the compressed mop material into the channel of the carrier. The mop material can be driven because it is compressed, and expands in the channel beyond the nip. The substantially rigid polymer channel forms a superior means for ensuring a secure engagement by the nip as well as a superior structure for the attachment of an elongated handle.

2. Prior Art

U.S. Pat. No. 2,224,462—Williams and U.S. Pat. No. 4,077,083—Siemund et al. are representative of conventional mop heads and methods for making the same. FIGS. 1–5 herein, labeled "prior art," show the structures and steps involved in making a mop head 20. The Williams patent is typical.

FIG. 5 is an end view of a finally assembled conventional mop head 20, with a metal-channel carrier 22 engaging on a block of sponge 24 that forms the absorbent mop material to be manipulated manually via an elongated handle (not shown). Carrier 22 and the handle are threaded or otherwise connectable. The metal channel 22 is ductile, and the side flanges 26 of the channel are formed to a relatively open configuration as shown in FIGS. 1 and 4, before the block of sponge or other compressible material is inserted. During the assembly process, flanges 26 are bent laterally inwardly, such that as assembled channel 22 is bent closed as shown in FIG. 5. Thus the block of sponge material 24 initially is expanded to its rest state as shown in FIGS. 2 and 3, and after assembly is compressed as in FIG. 5.

The flanges 26 preferably are preformed with inwardly folded lips 42, or lips 42 can be folded inward during the process of bending the ductile flange material inwardly against the sponge. FIG. 4 shows sponge material 24 in a state of compression between the rest state of FIGS. 2 and 3, and the partly compressed state of FIG. 5. In the expanded position of FIG. 2, the sponge material 24 typically is a rectangular block with opposite sides 28 that define its height and a top 32 that defines its width, e.g., about twice the height of the sidewalls 28.

The object is to provide a form of dovetail-like joint whereby the sponge is locked into the channel and cannot readily be extracted from the channel by forces tending to pull the sponge downwardly relative to the channel in FIG. 5. Such forces may occur in use, when the sponge is moved back and forth against a floor or the like, which tends to roll the sponge left and right as shown in FIG. 5. This could cause displacement of the sponge in the carrier and/or damage as lips 42 cut into the sponge. Such forces may also occur, for example, if the mop head is used in a roller mop with movable opposed rollers (not shown) that squeeze inwardly and are displaced downwardly against the lower part of the sponge for wringing.

In FIG. 3, the top wall 32 and portions of the sidewalls 28 of the sponge block are reinforced with a glued-on fabric sheet 34. The glue preferably is soaked into the sponge to a desired depth (indicated by shading 36). Before the glue sets firmly, sponge 24 can be wetted (not shown) to make it highly elastic, and squeezed to drive out excess water, whereupon the sponge and carrier channel are attached.

By FIG. 4, the top wall 32 of the sponge 24 has been pressed up into the open channel 38 defined by the carrier 22, through a throat defined between inturned lips 42. Flanges 26 in FIG. 4 are shown in their relatively more open position. Sponge 24 is slightly constricted between lips 42 of the carrier 22, such that the sponge 24 defines a waist 44 between its sidewalls 28. However, the constriction is not sufficient to substantially resist insertion of the sponge and is inadequate to form a secure joint. The sponge is pressed upwardly against the end of the channel and resides against the end of the channel but for any intervening glue. The waist 44 in FIG. 4 is about one-half the width of the top wall 32 in the rest state shown in FIG. 3.

Channel 22 is ductile sheet metal. Flanges 26 can be bent inwardly by lateral compression, slightly beyond the position shown in FIG. 5, and released to occupy the positions in FIG. 5. The bending can occur at the lateral comers of the channel, about 40°–45° in the arrangement shown, or the flanges can be bent generally into a more rounded dovetail shape. In any event, lips 42 are caused to further constrict waist 44 of sponge 24. The waist 44 is reduced by a factor of four or more relative to the width of the top surface 32 in the expanded position of FIGS. 2 and 3. The sponge 24 is retained in the carrier 22 partly by a pinching action of the inturned lips 42, partly by an adhesive bond between the glue and the carrier 22, and partly because hardening of the shaded region 36 forms a relatively more solid wedge-shaped plate, which resists the tendency of the sponge to come free of the carrier 22, in the manner of a dovetail joint.

Another manner of shaping and making a mop head is disclosed by U.S. Pat. No. 4,077,083. This mop head likewise comprises a carrier and a rectangular block of mop material having four elongated sides extending between spaced ends. However, each side has an elongated slit extending between the spaced ends, which slit defines a midline in each side. The carrier has an inverted-U shape defined by a top wall and two sidewalls. Each sidewall has a bottom edge formed with an inturned lip which projects inwardly, substantially toward the one other inturned lip. The free edges of the lips have enlargements such as wedges or barbs.

The method of making the mop head disclosed by U.S. Pat. No. 4,077,083—Siemund et al includes attaching a block of mop material to a carrier using barbed lips engaged in slits in the sides of uncompressed mop material. This evidently is accomplished either by sliding the carrier and mop material endwise relative to each other, or by forcibly pressing the mop material into the carrier until the mop material above the slit clears the barbed lips. This mop head is unlike Williams in that the carrier sidewalls are not bent as a part of the assembly operation.

It is advantageous if the mop material is held securely in the carrier and protected against damage from the lips in use. Siemund's arrangement is not apt for these purposes, due to the preliminary slitting of the sponge, the relative freedom of the uncompressed sponge to become displaced and to chew against the lips, and other factors. This form of mop also is particularly inapt for use with a wringing structure as in Williams.

Assemblies from bent-together flanged channels as in Williams are relatively secure, but are expensive. Metal is a relatively expensive material. Cutting and forming the metal initially to form an open channel, and then to bend the flanges inwardly, are expensive manufacturing steps and require good quality control. The requirements for protective fabric and glue add to the expense. The resulting sheet metal carrier is not optimal for achieving connection of a handle, and may necessitate various ears, channels, nut and bolt connections and the like for handle couplings (See, e.g., U.S. Pat. No. 4,908,901 —Torres), especially if a wringing assembly is included.

It would solve a number of the problems with metal channel carriers if the carriers could be made instead from a more economical material, like a polymer. However, polymer materials are not ductile and cannot be formed in the same manner as metal materials. It might be possible to use a thermoplastic polymer and to heat the polymer during assembly and then cool it, or perhaps to cure a thermoset or thermoplastic polymer while holding it in the required shape on a compressed sponge, these possibilities are impractical and likely to be characterized by worse problems than metal channels.

SUMMARY OF THE INVENTION

It is therefore an object of the invention to provide a mop head in which the carrier is made of substantially rigid polymer material and the mop material is substantially compressed in the carrier to form a secure joint.

It is another object to secure the mass of mop material in the carrier by substantially compressing the mop material, reducing its size in the joint from an at-rest size by a factor of several times, such as by four, eight or more times, resulting in a rugged and durable construction even without the aid of glue or the like.

It is also an object of the invention to provide a method by which a compressible mop material can be attached to a carrier having a channel and nip as described, including applying a substantial compressive force against the sides of the mop material such that the compressible material is made more rigid, and then aligning and applying a driving force against the mop material to force the mop material past the nip, the mop material expanding in the channel in a substantially compressed state, but being larger than the nip.

It is an aspect of the invention that the polymer carrier includes fixed flanges with cantilevered barbs, including shoulder portions positioned in comers between each flange and barb, which shoulders support the cantilevered barbs against the substantial forces induced by the substantially compressed mop material within the carrier.

It is another aspect that the flanges of the carrier define a tapering entrant section for the open channel, forming opposed ramps like in a funnel, for guiding the compressed mop material into the open channel of the carrier.

These and other aspects and objects are provided according to the invention in a mop head wherein a mass of mop material is affixed to a carrier made of a preformed polymer material. The mass of mop material, typically a block of sponge, is compressible through a range, from tight compression at which the material is dense and relatively more rigid, to its expanded rest state at which the material is soft and absorbent for mopping. The mop material can be a rectilinear block that is engaged by the preformed carrier such that the top and upper sides of the block remain relatively compressed and form a preferably keystone-shaped gripped portion. Outside the carrier, the bottom expands to its rest state and forms an operative mopping portion.

Preferably, the carrier is dimensioned such that the sponge or other mop material is substantially compressed within the carrier. The carrier has a tapered inverted-U shape generally defining an elongated open channel, namely with an elongated central web and two spaced flanges. Opposed cantilevered lips are integrally joined to each flange, and shoulder portions are formed in comers between each lip and flange.

The carrier can be sized to encompass an upper third of the sponge or other mop material. The lips are inclined and terminate in relatively sharp edges that catch or hook into the highly compressed mop material, so that the mop material is securely retained within the carrier against forces tending to pull the mop material out of the carrier channel. The carrier is preferably an integral piece of polymer and is relatively thick and rigid. The shoulders between each lip and flange support the cantilevered lips against the substantial forces induced between the highly compressed mop material and the carrier.

Preferably, the lips are inclined and define a space or throat between them. The width across the throat is several times less, for example eight times less, than the width across the top wall of the block of mop material in the mop material's expanded rest state. The shoulders form enlargements resembling a bead or a bulging strip in the polymer material, and define convex surfaces on the inside of the carrier. Preferably, the shoulders are large relative to the flanges and cantilevered lips. The flanges otherwise have generally planar inner surfaces, as do the cantilevered lips.

Preferably, each shoulder extends from a point halfway between the lip and the central web to a point on the lip halfway between the flange and the sharp edge of the lip. This arrangement provides support to the cantilevered lips against the forces induced by the compressed mop material in the channel, and helps to minimize the resilience of the polymer material. Facing downwardly, the opposed lips define surfaces inclined inwardly into the carrier channel, in the manner of a funnel.

The mop head is made according to the following steps. A carrier and a mass of mop material such as a block of sponge are supplied as described. Lateral compressive force is applied against the sides of the mop material to compress the mop material, preferably to a width substantially equal to the widest dimension between the inclined surfaces of the lips. Compression renders the mop material stiff. The compressed mop material is aligned with the carrier, and a driving force is applied against the bottom of the mop material to force the compressed mop material between the lips and into the carrier. When the compressive and driving forces on the mop material are released, the portion of the mop material in the channel remains somewhat compressed in a keystone shape, and is engaged by the channel to securely retain the upper portions of the mop material in the carrier. The lower portion of the mop material fans but toward its rest state of expansion.

The funnel-shaped entrant section of the channel between the inclined surfaces of the opposed lips is useful for guiding the compressed mop material into the channel. These inclined surfaces also provide an area in which the mop material is supported in a progressively more compressed state, leading up to the sharp corners of the lips. When the mop is used in making reciprocating strokes over a floor or the like, the progressively more compressed mop material below the sharp corners of the lips provides a buffer zone that reduces the extent to which the mop material can saw against the sharp corners by relative displacement of the mop material in the area of the corners. Thus the lips hold the mop material securely without biting through the compressed material (e.g., without breaking through the cells of a sponge mop material). This allows the use of relatively sharp corners for good mechanical engagement, although the corners can be rounded slightly as well. A gluing step is possible, but is not necessary to achieve sufficient engagement of the mop material and the carrier to provide a durable and long-lived mop head assembly. The polymer material is thick enough to provide a good means for attachment of the mop handle and/or fixtures of a wringing mechanism such as opposed rollers for compressing the mop material in a downward wringing motion.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings, FIG. 1 is a perspective view of a conventional metal channel sponge-carrier as typical of the prior art, with ductile metal flanges in a relatively spread-open position prior to their deformation to engage against a sponge block;

FIG. 2 is a perspective view of the sponge block to be assembled with the channel of FIG. 1;

FIG. 3 is an end view of the block of sponge in FIG. 2, showing a layer of reinforcing sheet glued over the top;

FIG. 4 is an end elevational view showing the sponge block of FIG. 3 loosely inserted into the sponge-carrier of FIG. 1;

FIG. 5 is an end elevational view corresponding to FIG. 4, except that the flanges have been bent inwardly to engage against the sponge, FIGS. 1–5 being labelled as prior art;

FIG. 8 is an enlarged section view taken through line VIII—VIII in FIG. 6; and, FIGS. 9–12 end elevational views that showing the method according to the invention whereby the block of mop material is affixed to the carrier of FIG. 6, wherein:

DETAILED DESCRIPTION OF THE PREFERRED EMBODIMENTS

Figure 6:
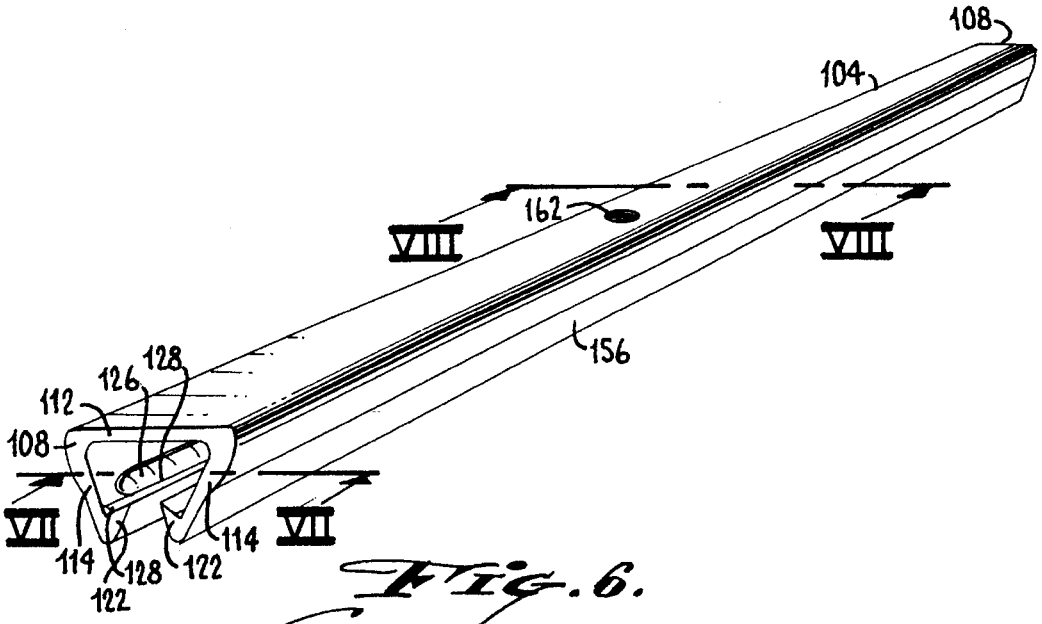
FIG. 6 is a perspective view of a molded channel carrier according to the invention, for carrying absorbent mop material such as sponge.
Figure 7A:
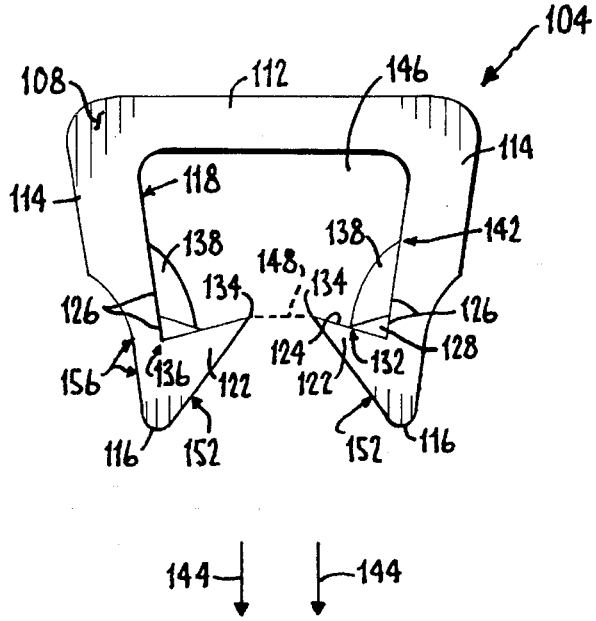
FIG. 7*a* is an enlarged end elevational view taken in the direction of arrows VII—VII in FIG. 6.
Figure 7B:
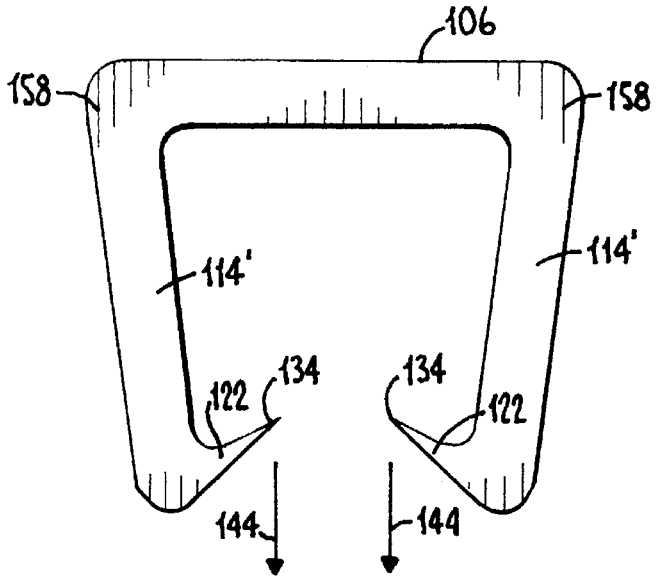
FIG. 7*b* is an end elevational view corresponding to FIG. 7*a*, showing an alternative embodiment of the carrier.
Figure 8:
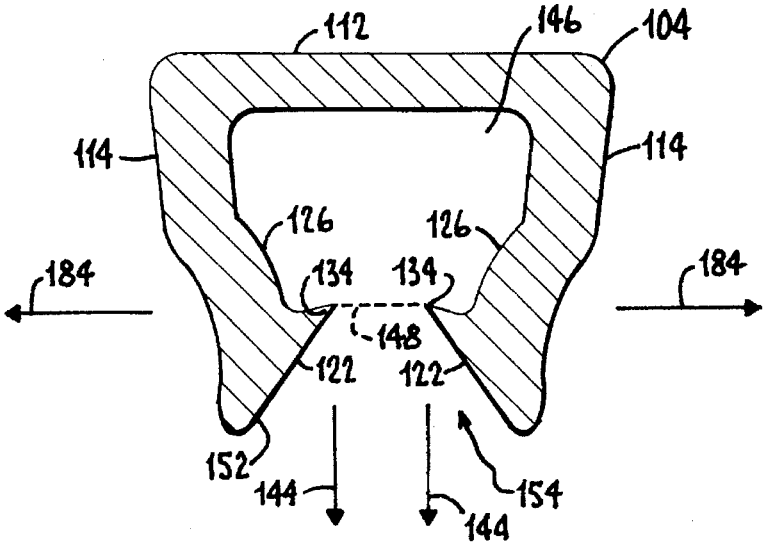
Figure 12:
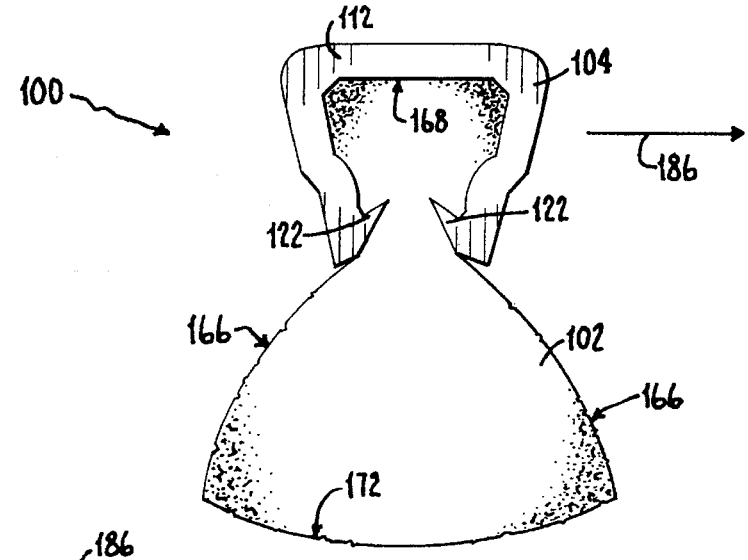

In FIG. 12, a mop head 100 according to the invention comprises a mass of absorbent, compressible mop material 102 and a carrier 104 for carrying the mass of mop material 102. The mop material 102 is tightly pinched, gripped and/or clamped in the carrier 104. Preferably, glue and similar adhesives are avoided. FIGS. 6, 7*a* and 8 show one embodiment 104 of the carrier according to the invention. FIG. 7*b* corresponds to FIG. 7*a*, and shows an alternative embodiment 106 of the carrier. The embodiment of FIG. 7*a* is for mopping applications that are more demanding (in respects described below) than the embodiment of FIG. 7*b*.

As shown in FIG. 6, 7*a*, 7*b* and 8, carrier 104 is shaped as an inverted channel elongated between ends 108. Carrier 104 has a central web 112 between outer flanges 114, and the flanges 114 taper toward one another in a direction that extends from the web 112 to distal edges 116. The flanges 114 generally define planar inner surfaces 118, inclined toward one another and extending between the web 112 and cantilevered lips 122. Lips 122 generally define planar inner surfaces 124. The inner surfaces 118 of the flanges 114 and the inner surfaces 124 of the lips 122 form corners where they meet.

The carrier is preferably an integrally molded polymer, but is structured to be strong and substantially rigid, i.e., only minimally resiliently deformable. A useful feature of the embodiment of FIG. 7*a* is that shoulders 126 are formed in the corners between the cantilevered lips 122 and the flanges 114. Each shoulder 126 is built up in two parts. A wedge of material 128 extends from a line 132 on lip 124 that is midway between inner sharp edges 134 and outer base ends 136 in the flange 114. Also an enlargement 138 forming a reinforcing bead or bulge extends from line 132 on lip 124 at the wedge 128 to a line 142 on the flange 118 that is about midway between lip 122 and web 112. The relatively larger second part 138 of the shoulder 126 defines a convex surface in section. FIG. 6 shows that wedge part 128 extends from end to end of carrier 104. The enlarged part 138 terminates at a point inwardly spaced from the ends of the carrier. Shoulder 126, including both parts 128 and 138, reinforces lips 122 against deformation due to forces acting in the direction of arrows 144.

An open channel 146 is formed by web 112, flanges 118, lips 124 and shoulder portions 126. The cantilevered lips 122 terminate in inner sharp edges or barb ends 134. The entrance to channel 146 forms an inclined throat 148. Lips 122 have inclined walls 152 that form a progressively narrower entrant section 154, i.e., cross sectionally resembling a funnel, which guides compressed mop material 102 through the throat 148 during assembly, as described below.

Flanges 114 can further have scalloped portions 156. These external scalloped recesses 156 reduce the use of material where the material would not add to the strength of carrier 104, as compared to a comparable embodiment in which the outer faces of flanges 114 were flat.

The alternative embodiment of the carrier 106 shown in FIG. 7*b* differs from the embodiment of FIG. 7*a* by the absence of shoulder portions (e.g., 126 in FIG. 8) between lips 122 and flanges 114'. In general, this renders the carrier flanges 114' less substantial, namely generally thinner in the upper portions 158. On the other hand, the scalloped recesses are also omitted in the lower portions. The carrier 104 in FIG. 7*a* is generally less deformable than carrier 106 in FIG. 7*b*. Carrier 104 is thus more durable, but is also more demanding for assembly purposes.

In FIG. 6, the carrier 104 has a hole 162 centrally located in the web 112 in which a mop handle (not shown) is coupled in a conventional manner, e.g., hole 162 can be threaded for receiving a fastener for the handle. Hole 162 represents a non-limiting example of a possible handle fastening means and can be replaced by or supplemented by any of the other well-known alternative structures for attaching handles and/or wringing mechanisms, such as patterns of holes, latch tunnels, hook engaging ears and the like, for example as disclosed by U.S. Pat. No. 4,908,901—Torres.

Carrier 104 is preferably integrally molded as a single piece of polymer material, e.g., vinyl or the like. The unit cost of a polymer carrier generally is less than that of a comparable metal carrier. Moreover, assembly of the carrier and the sponge or other mop material is facilitated, and the durability of the resulting device is improved, by use of the carrier shown.

For example, the conventional method of making mop head 20 (FIGS. 1–5) included the step of bending the metal flanges of the channel, which is not possible with the fixed flanges of a preformed substantially rigid integrally molded polymer. Polymer materials generally lack the strength of metal of equal volume, and according to the invention are reinforced in certain places.

Figure 9:
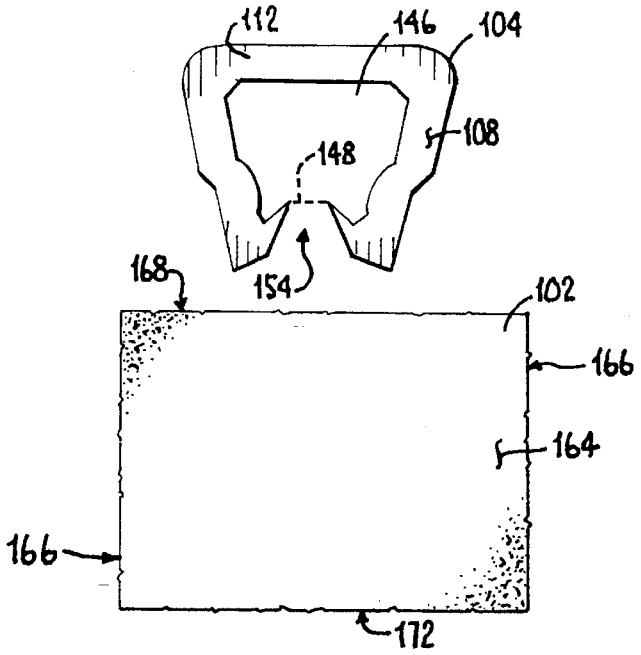
FIG. 9 shows the block of mop material in an expanded state and in registry with the open channel defined by the carrier.

The method according to the invention is shown in progressive stages by FIGS. 9–12. FIG. 9 is an elevational view of the end 108 of the carrier 104 (corresponding to the view in FIG. 7*a*), wherein the carrier 104 is shown placed above a mass of mop material 102. Mop material 102 is in its expanded rest state. In the drawings, the carrier 104 and the block of mop material 102 are shown horizontal during assembly. However, the carrier and block of mop material 104 and 102 can be assembled and used in any orientation, and, accordingly, terms like "up" and "down," "left" and "right," "top" and "bottom," "horizontal" and the like are used merely for convenience in this description and do not limit the method of making the mop head 100.

Figure 10:
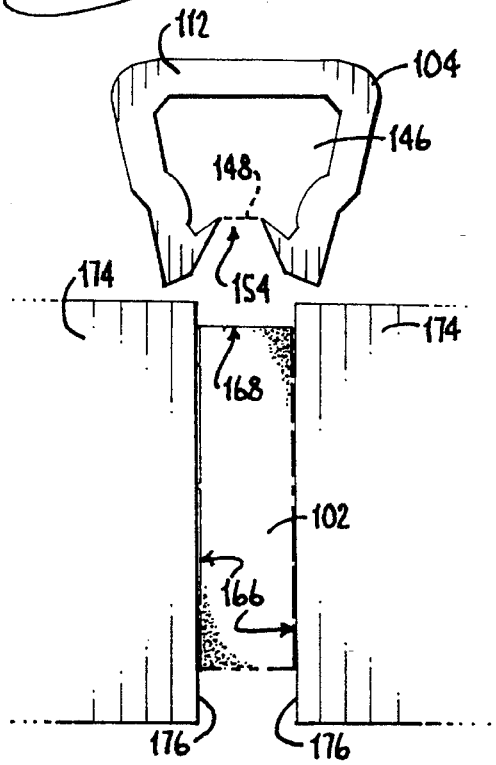
FIG. 10 shows a compressive force applied against the sides of the block of mop material, substantially compressing the block of mop material.

With reference back to FIG. 9, the mass of mop material 102 is generally a rectangular block with spaced ends 164 (one being shown), spaced sides 166, and a top and bottom wall 168 and 172, extending between the ends 164 and sides 166. The material 102 is resilient, and sides 166 thus define bearing surfaces against which a force can be applied to compress the block. In FIG. 10, a compressive force is applied against the spaced sides 166, sufficient to compress mop material 102 to a width comparable to the entrant section of carrier 104. As compared to the width of material 102 at rest, as shown in FIG. 9, the corresponding width in FIG. 10 is reduced by a factor of several times, preferably by a factor of four or five. Application of force not only compresses material 104, but also stiffens the block of mop material such that force applied to the bottom surface, in a direction transverse to the direction of compression, will move the block of mop material rather than simply compress the material from the bottom.

FIG. 10 shows the compressive force being applied by a spaced pair of blocks 174 with opposed flat faces 176. The blocks 174 can be operated such that both move oppositely, or one block 174 can be fixed while the other is moved. In any event, when compressed, the mop material is arranged such that its top wall 168 is in registry with the entrant section 154 of carrier 104.

Figure 11:
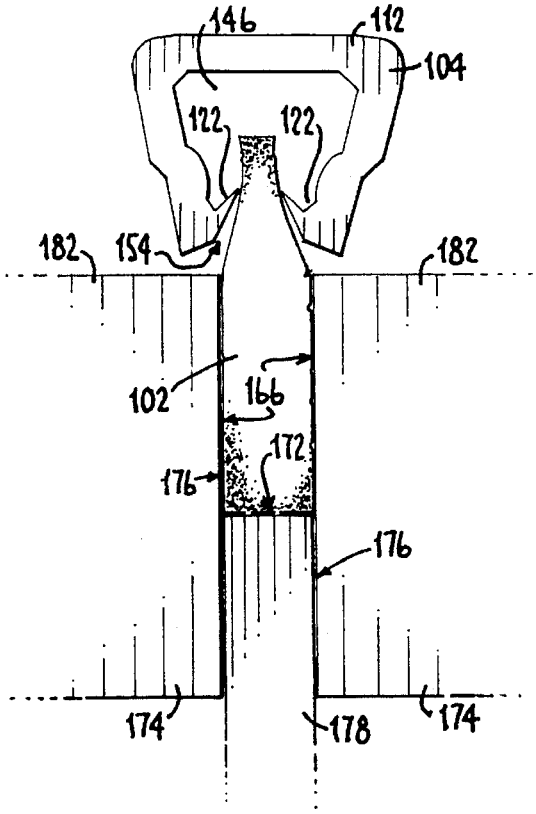
FIG. 11 shows a driving force applied against the bottom of the compressed mop material, forcing the top portion of the compressed mop material into the open channel of the carrier; and, FIG. 12 shows the mop material occupying the open channel of the carrier, and fanning out after the driving and compressive forces are released.

Advantageously, no gluing step or the like involving coating or soaking of an adhesive into the mop material is required. The compressed mop material is simply driven into the carrier, where it expands somewhat into a keystone shape, but remains relatively compressed and therefore stiffened. FIG. 11 shows a driving force being applied to the bottom face 172 of mop material 102, resulting in the compressed mop material 102 being displaced upwardly between blocks 174, into the open channel 146 of the carrier 104. The driving force can be applied by a movable plate 178 that has extended and retracted positions defining a vertical stroke sufficient for driving the mop material 102 until the top wall 168 bears against the web 112 of the carrier 104. Alternatively, the carrier 104, blocks 174 and mop material 102 therein can be held in fixed relative position and forced downwardly onto plate 178.

FIG. 11 represents a snap shot of the mop material 102 during the insertion process, which preferably is done in a quick motion that inserts the mop material into the carrier before the mop material can expand substantially after it passes beyond the top edges of blocks 174. The funnelling action of the entrant section can cause further compression, and the flanges of the carrier can be deflected resiliently outwardly to some extent in the process. As the top surface 168 of the mop material 102 passes the top edges 182 of blocks 174 and encounter the funnel-shaped entrant section 154 between lips 122, entrant section 154 guides the mop material by bearing against sidewalls 166, into channel 146. Assuming the throat 148 increases the compression of mop material 102 by a factor of two relative to FIG. 10, the compression is a factor of eight to ten relative to the rest state shown in FIG. 9. As the top 168 of mop material 102 passes lips 122, it becomes free to expand within the enlarged part of channel 146 beyond the lips 122. Channel 146 flares out on both sides immediately past the lips 122, forming a keystone or dovetail shaped opening as viewed from the end.

The driving force applied via plate 178 preferably moves mop material 102 clear against web 112 of carrier 104, filling the channel 146 as the material then expands. The driving force and the compressive force are released, and the lower half of the mop material 102 then is also free to expand below the lips 122. This lower half fans out as shown by FIG. 12, and due to the constriction of the mop material at the waist between lips 122, the bottom surface 172 assumes a rounded configuration, and mop material 102 forms an hourglass shape. In the nip between lips 122, the mop material proceeding downwardly from the sharp comers of the lips (i.e., in the entrant section) is progressively more expanded, and upwardly is progressively more compressed and stiffened. The entrant section provides a buffer between the bottom surface 172, where the mop material is expanded and readily displaced back and forth relative to the carrier, and the point at which the lips extend furthest inwardly to compress the mop material, where the mop material is stiff and securely fixed relative to the carrier. Accordingly, in the area of the sharp comers of lips 122, the mop material does not suffer damage due to displacement against the lips.

The flanges 114 of the embodiment of FIG. 7*a* are relatively thicker and stiffer than the flanges 114' of the embodiment of FIG. 7*b*. Consequently flanges 114 are less deformable and less apt to spread resiliently under force in the direction of arrows 184 in FIG. 8, induced by the highly compressed mop material 102 pushed through funnel-shaped entrant section 154. Likewise, flanges 114 remain closer to the rest state of carrier 104 than flanges 114' of carrier 106 while the mop material occupies channel 146 in use. This is because shoulders 126 in FIG. 7*a* reinforce lips 122 against laterally outward forces.

With vigorous mopping action, displacement of the bottom portion of the mop relative to the carrier, resulting from back and forth mopping strokes, causes mop material 102 to be shear stressed at the nip between lips 122, i.e., the mop material may tear at its anchor in the carrier 104. The carrier arrangement shown, and in particular the reinforced carrier of FIG. 7*a*, clamps the mop material tightly and prevents it from being rolled out of the carrier. At the same time, the carrier holds the mop material via a compressed and stiffened portion of the mop material inside the carrier, and provides a buffer at the entrant section that reduces the possibility of displacement of the mop material relative to the lips.

The embodiment of FIG. 7*b* has a number of the same advantages, but is less rigid because less reinforcement is included. By varying the material and thickness of the carrier as well as its reinforcement, it is possible to make a more durable or less durable mop head as desired. For a typical domestic sponge mop head with mop material about 7 cm in width at rest, it has been found that vinyl material about 2 to 4 mm thick, preferably about 2.3 mm thick, for a carrier having an external width of about 17 mm, will adequately hold the mop material when shaped as shown.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A method of making a mop head comprising the steps of:

providing a rigid minimally deformable carrier shaped as an elongated open channel, with spaced flanges comprising upstanding cantilevered retaining lips which form an entrant section to the carrier bounded by the edges of the lips, the edges of the lips defining an elongated planar throat;

supplying a compressible mass of mop material having a rest state of expansion and a portion to be gripped by and to be held within the carrier;

substantially compressing the mop material by first pressure means independent of the carrier;

aligning the compressed mop material portion to be gripped and held in registry with and outside the open channel;

applying to the mop material, a driving force by second pressure means independent of the carrier, said driving force applied in a direction which is generally perpendicular to the planar throat, whereupon the portion of the mop material to be gripped and held is disposed within the carrier such that the planar throat between the edges of the lips defines a planar waist in the mop material the waist being constricted when disposed between the edges of the lips:

removing both the compression applied by the first pressure means and the driving force applied by the second pressure means to allow the portion of the mop material to be gripped and held to expand in a compressed state within the channel and to allow the mop material which is not gripped by and held within the carrier to expand to its rest state of expansion outside the carrier.

2. The method of claim 1, wherein the retaining elements define barb-like projections in the open channel, and the driving step includes passing the mop material past the retaining elements.

3. The method of claim 1, wherein the retaining lips define barb-like projections in the open channel, and in applying the driving force the mop material passes over the retaining lips.

4. The method of claim 1, wherein the mop material is compressed such that its planar waist is constricted in size relative to the rest state of expansion of the mop material prior to said compressing.

5. A method of making a mop head comprising the steps of:

providing a rigid, minimally deformable carrier in a shape that defines an elongated open channel, with spaced flanges comprising upstanding cantilevered retaining lips which form an entrant section to the carrier bounded by the edges of the lips;

providing a mass of resiliently compressible mop material having a rest state of expansion;

compressing the mop material between opposed surfaces in a compression direction, thereby reducing the mop material in thickness and stiffening the mop material;

positioning the mop material as comprised and stiffened in registry with and outside of the open channel of the carrier;

applying a driving force against the mop material as compressed and stiffened in a direction perpendicular to the compression direction, thereby forcing a portion of the mop material through the entrant section of the carrier and into the open channel, such that the portion of the mop material forced through the entrant section and into the channel passes over the retaining lips and then expands in the channel and is engaged via the retaining lips; and, removing both the compression provided by the opposed surfaces and the driving force to allow the portion of the mop material not having passed through the entrant section and into the channel to expand to its rest state of expansion outside of the carrier.

6. The method of claim 5, wherein a planar waist is formed in the mop material at the location the retaining lips engage the mop material, the waist being reduced in thickness relative to the rest state of the mop material.

7. The method of claim 5, wherein the entrant section forms a transition zone between the sharp corners, at which the mop material is most compressed, to outside the channel, where the mop material expands to its rest state, the method comprising buffering via the entrant section between a relative displacement of the mop material and the channel occurring outside the channel in use, and a relative fixing of the mop material relative to the channel at the sharp corners of the lips.

8. The method of claim 7, wherein the entrant section forms a transition zone between the sharp corners, at which the mop material is most compressed, to outside the channel, where the mop material expands to its rest state.

* * * * *